United States Patent [19]

Ostrobrod

[11] Patent Number: 4,660,679

[45] Date of Patent: Apr. 28, 1987

[54] SAFETY ALARM TRIPOD

[76] Inventor: Meyer Ostrobrod, 11990 Lockart Rd., Philadelphia, Pa. 19116

[21] Appl. No.: 827,708

[22] Filed: Feb. 10, 1986

[51] Int. Cl.[4] ..... A62B 33/00; A62B 35/00

[52] U.S. Cl. ..... 182/18; 182/5; 182/145; 116/3; 116/67 R; 116/202

[58] Field of Search ..... 182/18, 19, 142, 3–7, 182/145; 116/3, 67 R, 67 A, 202

[56] References Cited

U.S. PATENT DOCUMENTS

| | | | |
|---|---|---|---|
| 2,493,853 | 1/1950 | Bossetta | 182/18 |
| 3,298,012 | 1/1967 | Weller | 182/18 |
| 4,511,123 | 4/1985 | Ostrobrod | 182/234 |
| 4,589,523 | 5/1986 | Olson | 182/234 |

*Primary Examiner*—Reinaldo P. Machado
*Attorney, Agent, or Firm*—Norman E. Lehrer

[57] ABSTRACT

A tripod utilized over a manhole or the like to aid in the introduction or removal of a workman or equipment into the hole includes a housing and three legs extending downwardly and outwardly from the housing. An elongated rod extends vertically through the housing and includes a support member in the form of a loop or hook. A fall protection device may be suspended from the support member and includes a cable connected to a harness worn by a workman. In the event of a fall, the weight of the workman pulls the support member and rod downwardly against the force of a spring located within the housing until a limit switch carried by the rod activates an audible and visual alarm. A nut threaded onto the top part of the rod can be moved down against the top of the housing to prevent downward movement of the rod. This allows the tripod to be used to lower heavy equipment without activating the alarm.

19 Claims, 8 Drawing Figures

SAFETY ALARM TRIPOD

BACKGROUND OF THE INVENTION

The present invention is directed toward a tripod and more particularly toward a tripod of the type utilized over a manhole or the like to aid in the introduction or removal of a workman or equipment into or out of the hole and which includes an alarm therein which emits a signal whenever a weight suspended from the tripod exceeds a predetermined level. The tripod of the invention can, therefore, be utilized to indicate when a workman has fallen and needs assistance.

The invention has particular use with fall protection devices such as shown in Applicant's U.S. Pat. No. 4,511,123. Such devices are personal fall arrest systems which are used in conjunction with other components such as a tripod or the like for anchoring the device and a body harness which is worn by a workman.

Safety devices of this kind are normally comprised of a housing which is adapted to be suspended from either an elevated structure or from a tripod or the like above a manhole. A rope or cable winding drum is rotably mounted in the housing and a spiral spring drives the drum in a direction which continuously tends to wind the cable around the drum. A centrifugally operated brake mechanism reponds to an initial fast rotation of the drum in the unwinding direction and brakes the rotation of the drum to prevent further unwinding thereof.

In use, these safety devices are fixed to a structure such as a building, bridge or the like and the cable extending therefrom is fastened to a worker's belt or harness. Under normal working conditions, i.e. as the worker moves from one place to another and the rope is drawn in and out of the housing at a reasonable speed, the centrifugal brake is never engaged since the speed of rotation of the drum is relatively slow. Accordingly, the drum rotates freely and the rope is drawn out or wound on the drum freely. In the event of a fall, however, the rope is drawn out rapidly and the drum is then rotated at a high speed. As a result, the centrifugally operated brake is actuated preventing further rotation of the drum which stops the rope from being drawn out. This prevents injury or death to the worker which otherwise would occur as a result of the fall.

When a worker has fallen and is being suspended by the rope from the safety device, he may be able to climb to safety or he may have to be lifted using either auxiliary lifting equipment or by utilizing the lifting portion of Applicant's safety device shown in U.S. Pat. No. 4,511,123. There are times, however, when a workman may fall and need assistance to be lifted to safety but when his co-workers may not be aware of his need for assistance. This may occur, for example, when such a safety device is utilized with a tripod for allowing a workman to descent into a manhole or similar confined space. Since the workman is not in view, his co-workers would not be aware that he has fallen and needs assistance, particularly if he is injured to the point that he cannot call out for help. In view of the fact that the environment in which such workers are normally operating may contain hazardous substances, it is often important to lift the fallen worker as quickly as possible.

To the best of Applicant's knowledge, no one has ever attempted to devise a system for addressing the problem which Applicant's invention solves. Heretofore, it has always been necessary for a second worker to remain on the ground directly next to the tripod to constantly observe the safety device to determine whether the braking mechanism has been activated by a worker falling. This not only requires additional man power but is often ineffective at night since it is difficult to observe the cable and safety device.

SUMMARY OF THE INVENTION

The invention provides a means for singaling to co-workers when a workman has fallen into an area where he cannot be seen. According to the invention, a tripod utilized over a manhole or the like to aid in the introduction or removal of a workman or equipment into the hole includes a housing and three legs extending downwardly and outwardly from the housing. An elongated rod extends vertically through the housing and includes a support member in the form of a loop or hook. A fall protection device may be suspended from the support member and includes a cable connected to a harness worn by a workman. In the event of a fall, the weight of the workman pulls the support member and rod downwardly against the force of a spring located within the housing until a limit switch carried by the rod activates an audible and visual alarm. A nut threaded onto the top part of the rod can be moved down against the top of the housing to prevent downward movement of the rod. This allows the tripod to be used to lower heavy equipment without activating the alarm.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
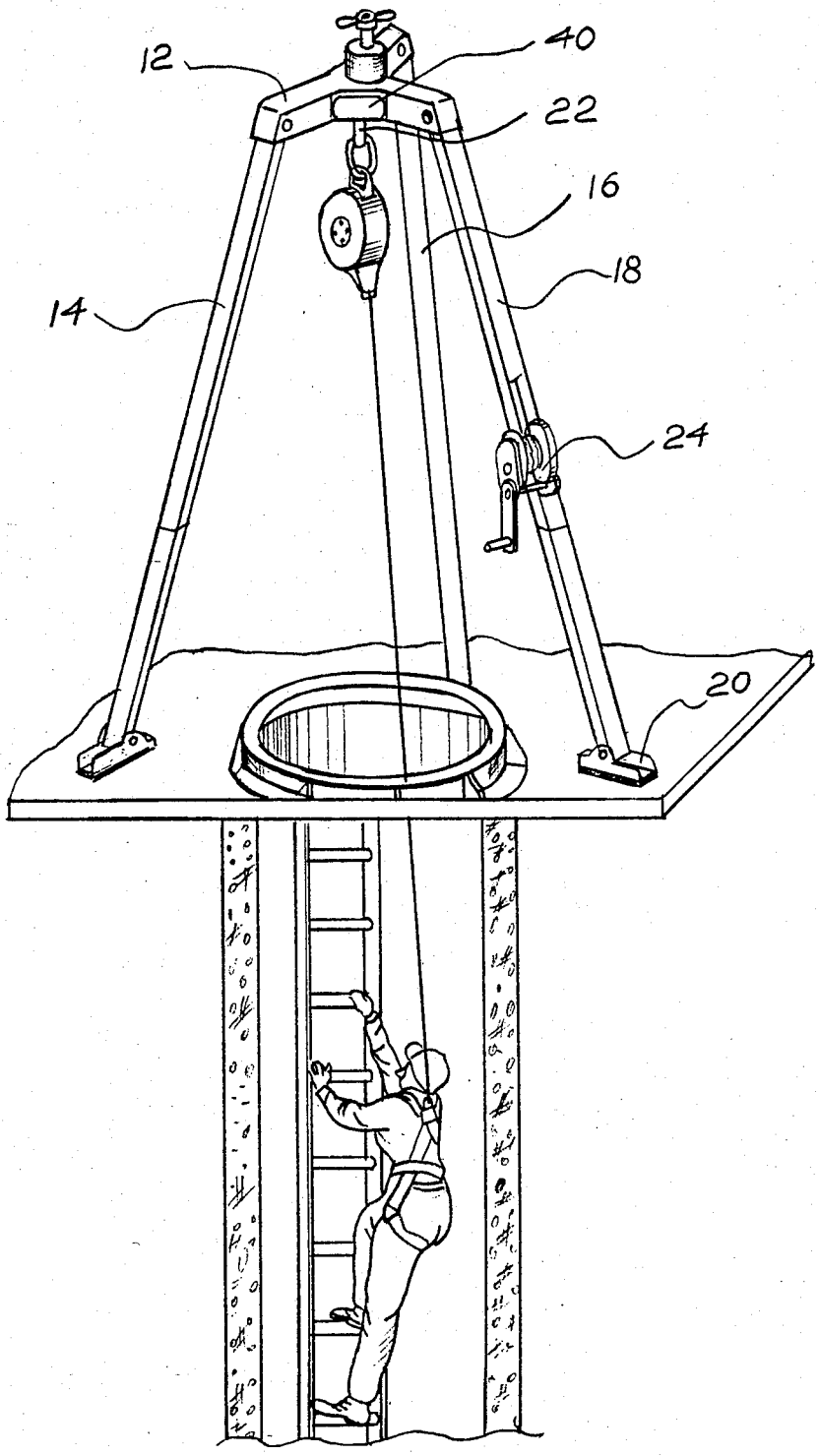
FIG. 1 is a perspective view of a safety alarm tripod constructed in accordance with the principles of the present invention.

Referring now to the drawings in detail wherein like numerals have been used throughout the various figures to designate like elements, there is shown in FIG. 1 a perspective view of a safety alarm trpod constructed in accordance with the principles of the present invention and designated generally as 10, Tripod 10 is comprised essentially of an upper substantially horizontally disposed housing 12 and three legs 14, 16 and 18 which are substantially equally spaced around the perimeter of the housing 12 and which extend downwardly and outwardly therefrom in a known manner. The legs are preferably pivotally attached to the housing 12 so that the tripod can be collapsed for portability by pivoting the legs inwardly. Furthermore, each leg is preferably constructed of two parts which telescope with respect to each other so that the height of the tripod can be adjusted and so that the tripod can be collapsed to be more compact for carrying. A foot such as foot 20 is pivotally secured to the bottom of each leg to support the tripod on the ground.

Extending downwardly from the center of the housing 12 and located between the legs 14, 16 and 18 is a support member 22 which preferably is in the form of a ring or hook. A fall protection safety device such as that disclosed in Applicant's above cited patent can be attached to the support member 22 when it is desired to utilize the tripod in a fall protection system for a worker. Alternatively, a pulley can be suspended from the support member 22 so that heavy equipment or the like can be lowered into a manhole utilizing the winch 24 secured to leg 18.

Figure 2:
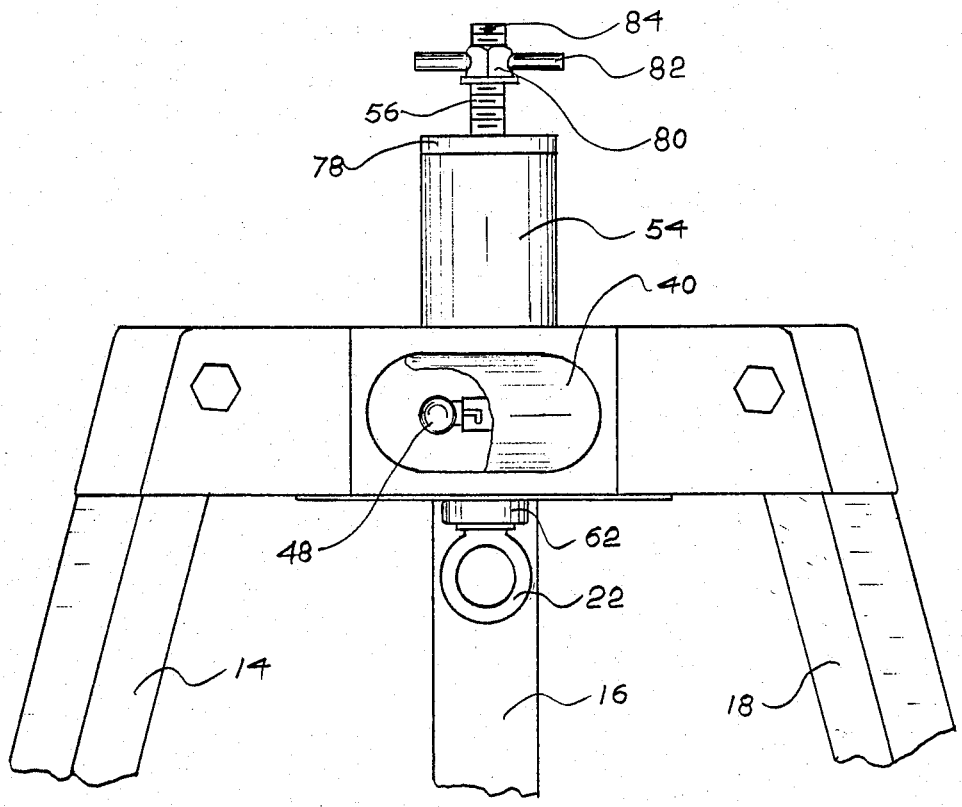
FIG. 2 is a front elevational view of the upper part thereof.
Figure 3:
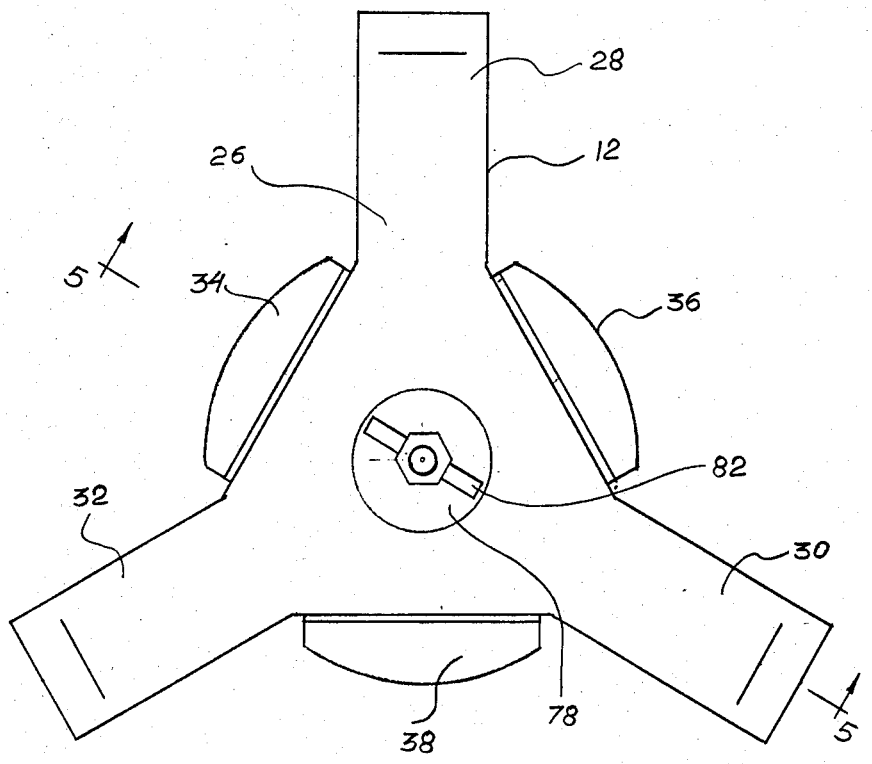
FIG. 3 is a top plan view of the upper housing.
Figure 4:
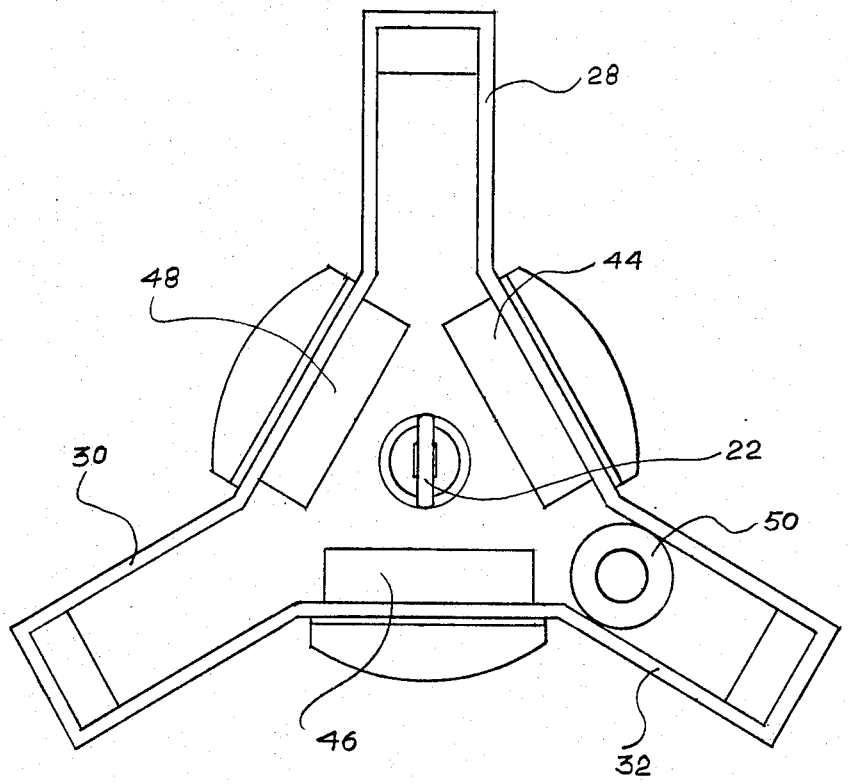
FIG. 4 is a bottom plan view of the housing.

As shown most clearly in FIGS. 3 and 4, the housing 12 is essentially triangular in shape and includes a central portion 26 and three outwardly extending leg support portions 28, 30 and 32 to which the legs are pivotally secured. Three electric lights 34, 36 and 38 are mounted on the side walls of the central portion 26 of the housing 12 with one light mounted between each pair of leg portions. Each electric light is comprised of a lens cover 40 and an electric bulb 42 therebehind as shown in FIG. 2.

FIG. 4 is a bottom view of the housing 12 with the legs and cover plate removed. A plurality of rechargeable batteries are located within the housing and are wired to the lights and the remaining electrical circuit parts to be described in a known manner. While not specifically shown, the housing also carries an electrical jack which can be connected to a power supply for recharging the batteries without having to remove them from the housing. Also located within the housing is an audible alarm 50 which may be an electric horn, siren or the like.

Figure 5:
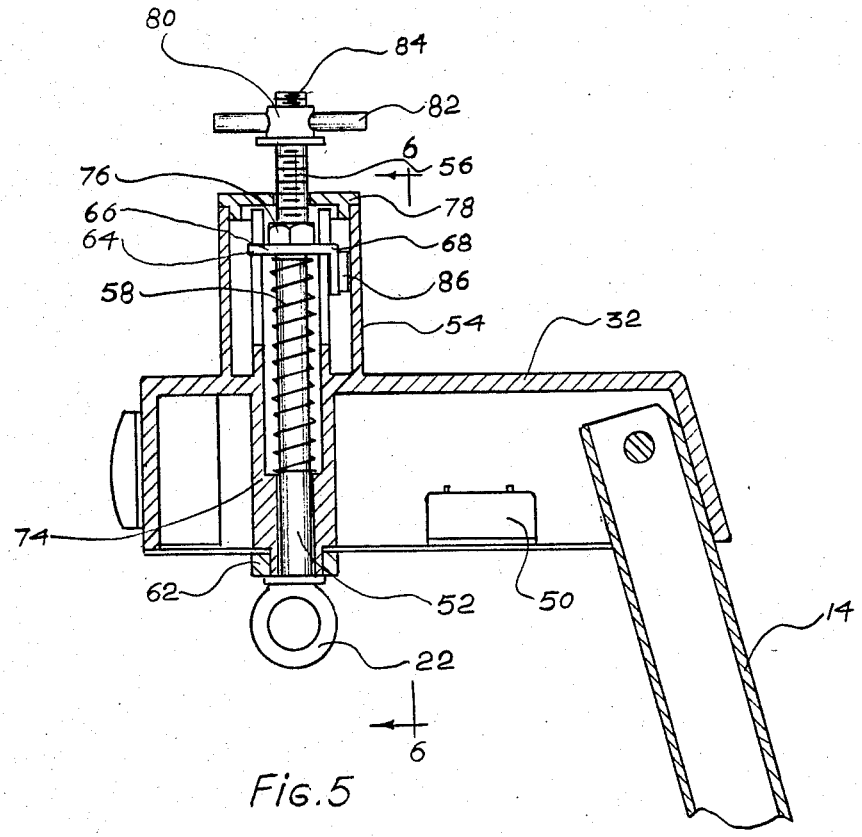
FIG. 5 is a partial cross-sectional view taken through the lines 5—5 of FIG. 3.

As shown in FIG. 5, the support member 22 is secured to the lowermost end of an elongated rod 52. Rod 52 extends upwardly into the interior of the housing 12 and through the upper end of the top portion 54 of the housing. Either the entire rod 52 or at least the upper section thereof has a screw thread 56 formed thereon. Surrounding the central portion of the rod 52 is a compression spring 58. The central portion of the rod 52 and the entire spring 58 are located within a cylindrically shaped guide 60 within the housing 12. As can be seen in FIG. 5, upward movement of the rod 52 is stopped when the uppermost end of the support member 22 engages the flange 62 at the bottom of the housing 12.

Figure 7:
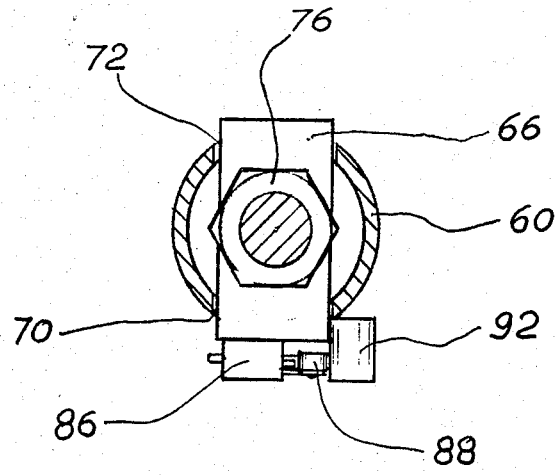
FIG. 7 is a partial cross-sectional view taken through the lines 7—7 of FIG. 6.
Figure 8:
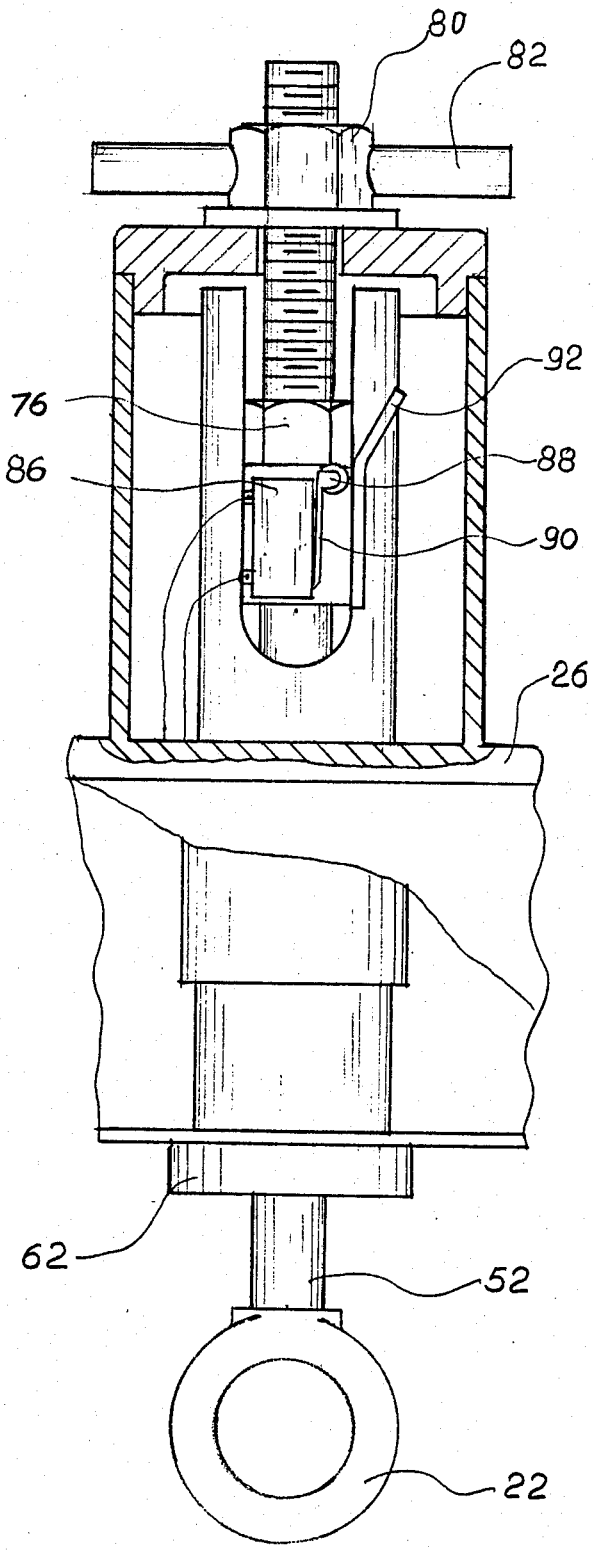
FIG. 8 is a partial cross-sectional view similar to FIG. 6 but showing the device in its operative condition with the alarm activated.

A substantially L-shaped bracket 64 has an opening therein which allows the same to be placed over the rod 52 within the housing 12. The bracket 64 includes a horizontally disposed portion 66 and a downwardly extending portion 68. The length of the horizontal portion 66 is greater than the diameter of the cylindrical member 60. Accordingly, slots 70 and 72 are formed in the side walls of the cylinder 60 to accommodate the ends of the bracket 64. As can be seen from FIG. 7, the size of the slots are substantially the same as the width of the bracket. As a result, the side walls of the slots 70 and 72 also function to prevent rotational movement of the bracket 64.

Bracket 64 overlies spring 58 which is thereby maintained in place between the lower surface of the bracket 64 and the flange 74 in the lower part of the housing. The bracket is restrained from vertical movement as a result of the nut 76 threaded onto the threads 56 of rod 52 above the bracket. The vertical position of the bracket 64, however, can be adjusted within a certain range by tightening or untightening the nut 76. As shown in FIG. 5, the rod 52 extends through the top wall 78 at the uppermost part of the housing. A second nut 80 having a handle 82 secured thereto is screwed onto the uppermost end of the rod. It should be readily apparent to those skilled in the art that when a downward force or weight is applied to the support member 22, the rod 52 will move downwardly until the lower surface of the nut 80 engages the upper surface of the housing top 78. However, if nut 80 is moved downwardly along the length of the upper portion of the rod 52 by rotating the same until the lower surface thereof engages the top of the housing, a downward force on the support member 22 will not move the rod 52 since the nut 80 will function as a stop preventing any downward movement. A pin 84 extending through the uppermost end of the rod 52 prevents the nut 80 from being accidentally removed from the rod when it is secured upwardly.

Figure 6:
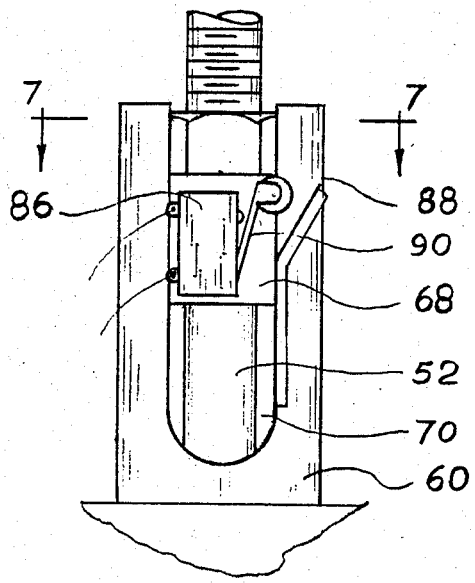
FIG. 6 is a partial cross-sectional view taken through the lines 6—6 of FIG. 5.

A limit switch 86 is secured to the downwardly extending portion 68 of the bracket 64. Limit switch 86 includes a switch body and a switch activator in the form of a cam roller 88 located at the end of lever 90. When the rod 52 is in its uppermost position, i.e. when there is substantially no weight or a very small weight on the support member 22, the switch 86 and roller 88 are in the upper or imoperative position shown in FIG. 6. However, when a downward force or weight which exceeds a predetermined level is applied to the support member 22, the rod 52 and the switch 86 move downwardly. Located next to the switch 86 and fixedly secured to the housing is a cam surface 92. As the switch is moved downwardly, the roller 88 engages the cam surface 92. Further downward movement causes the roller 88 and lever 90 to move inwardly thereby activating the switch 86.

The safety alarm tripod 10 of the invention is utilized in the following manner. A fall protection safety device such as shown in Applicant's prior patent is attached to the support member 22. The spring 58 is selected so that the weight of the safety device will be insufficient to substantially move the rod 52. When the worker descends into a manhole or the like with the cable from the safety device attached to his harness, the rope moves in and out of the safety device in the known manner putting little or no additional force on the spring 58. However, in the event that the workman should fall, the brake mechanism within the safety device operates and the workman's entire weight is then suspended from the safety device and thus form the support member 22. This weight is sufficient to overcome the force of spring 58. Accordingly, the rod 52 moves downwardly carrying the switch 86 with it. Roller 88 engages the cam surface 92 and eventually moves lever 90 inwardly to activate the switch which closes the circuit to the lights and the audible alarm 50 thereby summoning help. The fallen worker can then be lifted to safety.

The predetermined weight level which must be exceeded in order to activate the alarm signal is determined primarily by the force of spring 58. However, some adjustment can be made by moving the nut 76 up or down to put more or less tension on the spring and to position the limit switch 86 closer to or further away from the cam surface. In the preferred embodiment, the spring is selected so that a weight in excess of approximately 100 pounds would be required before the alarm would be activated.

Whenever it is desired to utilize the tripod 10 to lower equipment or the like into a manhole, the alarm must be deactivated. Otherwise, the alarm would continue to sound if the weight of the equipment being lowered exceeded 100 pounds (or some other predetermined amount). To accomplish this, the nut 80 is rotated utilizing the handle 82 until it moves downwardly to engage the upper surface of the housing top 78. This position is shown in phantom in FIG. 5. A pulley can then be attached to the support member 22 and utilizing the winch 24, equipment can be lowered into or raised from the manhole. Because of the position of the nut 80, downward movement of the rod 52 is prevented irrespective of the weight applied to the support member 22. Accordingly, the alarm will never be activated.

The present invention may be embodied in other specific forms without departing from the spirit or essential attributes thereof and accordingly reference should be made to the appended claims rather than to the foregoing specification as indicating the scope of the invention.

I claim:

1. A safety alarm tripod comprising:

a substantially horizontally disposed housing;

three legs substantially equally spaced around the perimeter of said housing and extending downwardly and outwardly therefrom;

a support member carried by said housing and extending downwardly from substantially the center thereof between said legs, said support member being adapted to support a weight suspended therefrom;

alarm means within said housing and being connected to said support member, said alarm means being activated to emit a signal whenever the weight suspended from said support member exceeds a predetermined level.

2. The invention as claimed in claim 1 further including means associated with said support member for preventing said alarm means from being activated even when said weight exceeds said predetermined level.

3. The invention as claimed in claim 1 further including means for changing said predetermined level.

4. The invention as claimed in claim 1 wherein said alarm means is electrically operated and wherein an electric power source is contained within said housing.

5. The invention as claimed in claim 4 wherein said signal emitted by said alarm means is both an audible signal and a visual signal.

6. The invention as claimed in claim 5 wherein said visual signal is emitted by three electric light means, each of said electric light means being mounted on said housing between a different pair of said legs.

7. The invention as claimed in claim 1 wherein said support member includes an elongated rod secured thereto which extends upwardly into the interior of said housing; spring means within said housing resisting downward movement of said rod; said rod carrying a portion of a means for activating said alarm means whenever said rod moves downwardly a predetermined distance against the force of said spring means.

8. The invention as claimed in claim 7 including means for adjusting the force of said spring.

9. The invention as claimed in claim 7 wherein said alarm means is electrically operated and wherein said activating means includes a limit switch and a switch activator; one of said switch and switch activator being carried by said rod for movement therewith and the other being stationary within said housing.

10. The invention as claimed in claim 9 further including an electric power source within said housing.

11. The invention as claimed in claim 10 wherein said signal emitted by said alarm means is both an audible signal and a visual signal.

12. The invention as claimed in claim 11 wherein said visual signal is emitted by three electric light means, each of said electric light means being mounted on said housing between a different pair of said legs.

13. The invention as claimed in claim 7 further including means for preveting downward movement of said rod.

14. The invention as claimed in claim 13 wherein said rod extends upwardly through the top of said housing; said means for preventing downward movement of said rod including means adapted to be secured to the upper portion of said rod above said housing and which engages the top of said housing when downward movement of said rod is attempted.

15. The invention as claimed in claim 14 wherein at least the portion of said rod extending above the top of said housing has a screw thread thereon and wherein said preventing means includes a nut threaded onto said rod and movable between an upper position wherein said rod is movable and a lower position wherein it engages the top of said housing to prevent downward movement of said rod.

16. The invention as claimed in claim 15 wherein said alarm means is electrically operated and wherein said activating means includes a limit switch and a switch activator; one of said switch and switch activator being carried by said rod for movement therewith and the other being stationary within said housing.

17. The invention as claimed in claim 16 further including an electric power source within said housing.

18. The invention as claimed in claim 17 wherein said signal emitted by said alarm means is both an audible signal and a visual signal.

19. The invention as claimed in claim 18 wherein said visual signal is emitted by three electric light means, each of said electric light means being mounted on said housing between a different pair of said legs.

* * * * *